US008424611B2

(12) United States Patent
Smith et al.

(10) Patent No.: US 8,424,611 B2
(45) Date of Patent: Apr. 23, 2013

(54) DOWNHOLE SAFETY VALVE HAVING FLAPPER AND PROTECTED OPENING PROCEDURE

(75) Inventors: Roddie R. Smith, Cypress, TX (US); Michael J. Foster, Westhill (GB); Eric Johnson, Sugar Land, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 267 days.

(21) Appl. No.: 12/548,853

(22) Filed: Aug. 27, 2009

(65) Prior Publication Data

US 2011/0048742 A1 Mar. 3, 2011

(51) Int. Cl.
*E21B 34/14* (2006.01)

(52) U.S. Cl.
USPC ..... 166/386; 166/332.4; 166/332.8; 251/301

(58) Field of Classification Search ..... 166/386, 166/332.4, 332.8; 251/82, 83, 301, 302, 251/303
See application file for complete search history.

(56) References Cited

U.S. PATENT DOCUMENTS

| | | | | |
|---|---|---|---|---|
| 2,162,578 | A * | 6/1939 | Hacker | 175/248 |
| 4,339,001 | A | 7/1982 | Paschal | |
| 4,449,587 | A | 5/1984 | Rodenberger et al. | |
| 4,520,870 | A | 6/1985 | Pringle | |
| 4,574,883 | A | 3/1986 | Carroll et al. | |
| 4,601,342 | A * | 7/1986 | Pringle | 166/323 |
| 4,624,315 | A | 11/1986 | Dickson et al. | |
| 4,723,606 | A * | 2/1988 | Vinzant et al. | 166/319 |
| 5,145,005 | A | 9/1992 | Dollison | |
| 7,178,600 | B2 | 2/2007 | Luke et al. | |
| 7,204,315 | B2 | 4/2007 | Pia | |
| 7,455,116 | B2 | 11/2008 | Lembcke et al. | |
| 7,677,304 | B1 * | 3/2010 | Smith | 166/237 |
| 2005/0230118 | A1 * | 10/2005 | Noske et al. | 166/332.8 |
| 2007/0284119 | A1 | 12/2007 | Jackson et al. | |

FOREIGN PATENT DOCUMENTS

| | | |
|---|---|---|
| EP | 2159370 | 3/2010 |
| GB | 2422393 | 7/2006 |
| GB | 2439187 | 12/2007 |
| GB | 2458771 | 10/2009 |

OTHER PUBLICATIONS

Search Report, Application No. GB1011987.3, dated Sep. 20, 2010.

(Continued)

*Primary Examiner* — William P Neuder
*Assistant Examiner* — Richard Alker
(74) *Attorney, Agent, or Firm* — Wong, Cabello, Lutsch, Rutherford & Brucculeri, L.L.P.

(57) ABSTRACT

A downhole valve has a closure device (e.g., one or more flappers) for closing off the valve. A no-go actuation mechanism protects the flappers from damage. When the flappers are closed, the mechanism prevents a tool from passing into the valve and causing damage to the flappers. Yet, the mechanism may open the valve's flappers when the tool string is forced into the valve. When the valve has successfully opened, then the mechanism moves out of the way of the toolstring so it can pass through the valve. For the mechanically operated valves, operators use a shifting profile in the valve only in the upward direction to return the valve to the closed position. For hydraulic actuated valves, hydraulic pressure may be used or exhausted, depending on the design, to allow the flappers to go closed. Once the flappers have closed, the no-go mechanism is once again realized.

22 Claims, 5 Drawing Sheets

OTHER PUBLICATIONS

Weatherford, "7-in. Completion Isolation Valve (CIV/S) with stinger in three positions," dated Feb. 15, 2001.
Weatherford, "9-5/8-in. Completion Isolation Valve (CIV/S)," undated.
Makin, Graham, "Completion valves continue evolution," Hart's E&P, pp. 57-58, dated May 2001.
U.S. Appl. No. 12/200,463, entitled "Passable No-Go Device for Downhole Valve," filed Aug. 28, 2008.
Office Action in U.S. Appl. No. 12/200,463, mailed Mar. 27, 2009.
Reply to Office Action in U.S. Appl. No. 12/200,463, filed Jun. 19, 2009.

* cited by examiner

DOWNHOLE SAFETY VALVE HAVING FLAPPER AND PROTECTED OPENING PROCEDURE

BACKGROUND

Operators perform completion operations during the life of a well to access hydrocarbon reservoirs at various elevations. Completion operations may include pressure testing the tubing, setting a packer, activating safety valves, or manipulating sliding sleeves. In certain operations, it may be desirable to isolate one portion of the completion from another. Typically, an isolation valve having an internal ball valve is disposed in the completion to isolate portions of the well. One example of such an isolation valve is the completion isolation valve (CIV) from Weatherford.

FIG. 1A shows a completion isolation valve 10 in an opened condition with the ball valve 20 allowing flow through the valve's bore 12. When running a tool string through the open valve 10, operators insert a profiled stinger 30 on the end of the tool string into the valve 10 as shown in FIG. 1B. The stinger 30 engages dogs 16 in the valve 10. Downward movement of the stinger 30 engaged by the dogs 16 then moves a shifting mechanism 14 to lock the internal ball valve 20 open. Once the valve 10 is opened, a tool string can be passed through the valve 10 to work on the lower completion. To remove the tool string, operators lift the profiled stinger 30 at the end of the string back into the valve 10. As shown in FIG. 1C, the stinger 30 raised in the upward direction closes the internal ball valve 20 by engaging the dogs 16 as the stinger 30 passes up through the valve 10.

Although effective in isolating portions of a completion, valves using internal ball valves have several drawbacks. For example, ball valves require a large wall thickness to house it. The increased wall thickness required by a ball mechanism makes it have either a smaller ID or a larger OD than the flapper designs. To overcome such drawbacks, isolation valves have been developed that use flappers to isolate portions of a completion. One example of such a valve having dual flappers is the Optibarrier available from Weatherford and disclosed in U.S. patent application Ser. No. 11/761,229, entitled "Dual Flapper Barrier Valve," which is incorporated herein by reference in its entirety.

In many valves used downhole, operators use shifting sleeve profiles to mechanically actuate the valve open and closed. Unfortunately, operators deploying a tool downhole to mechanically actuate the valve may inadvertently miss engaging the profile during run in. In such a circumstance, the tool string may slip through and run into the closed valve, damaging the closure device and rendering the valve inoperable. To avoid this, operators must pay careful attention while running a tool in the hole so as not to damage any downhole valves.

The subject matter of the present disclosure is directed to overcoming, or at least reducing the effects of, one or more of the problems set forth above.

SUMMARY

A downhole valve has one or more flappers for closing off the valve, and a no-go actuation mechanism protects the one or more flappers from damage. When the one or more flappers of the valve are closed, the no-go mechanism prevents a tool from passing into the valve and causing damage to the one or more flappers. Yet, the passable no-go mechanism is used to open the valve's one or more flappers when the tool string is forced into the valve. When the valve has been successfully opened, then the no-go mechanism is moved out of the way of the tool string so the tool string can pass through the valve. Operators use a shifting profile in the valve only in the upward direction to mechanically return the valve to the closed position.

In one implementation, the protected valve has a bore with a closure disposed therein. The closure can include one flapper, or the closure can include dual flappers (i.e., upper and lower flappers) disposed in the bore. For the dual flapper arrangement, the flappers are rotatable in opposing directions between opened and closed positions in the bore.

When the valve deploys downhole, a tool may be deployed into the valve either intentionally or unintentionally. For example, the tool may be a stinger on the end of a tool string intended to reach a portion of the wellbore below the valve. Alternatively, the deployed tool can be any arbitrary tool inadvertently deployed by operators into the closed valve. In either case, the tool engages against at least one dog extendable into the valve's bore as the tool moves downhole into the valve while closed. The tool engaged against the dog shifts a sleeve while the tool moves downhole. The closure is automatically actuated with the sleeve from the closed condition to the opened condition before the tool moves downhole to the closure. For the closure having dual flappers, for example, the flappers rotate open before the tool moves downhole to the flappers, and the lower flapper preferably rotates open before the upper flapper.

For hydraulic actuated downhole valves, hydraulic pressure may be used or exhausted, depending on the design, to allow the one or more flappers to go closed. Once the flapper has closure, the no-go mechanism is once again realized. For the mechanically operated downhole valves, however, operators use a shifting profile in the valve only in the upward direction to mechanically return the valve to the closed position. If the tool is a stinger intentionally deployed into the valve, for example, then the stinger can be used to close the valve as the stinger is pulled uphole through the valve. In particular, a shoulder on the stinger engages against a profile in the sleeve as the stinger moves uphole through the open valve. The sleeve with the stinger engaged against the profile shifts uphole and automatically closes the closure. For example, the flappers rotate closed with the shifting of the sleeve with the upper flapper preferably closing before the lower flapper.

The foregoing summary is not intended to summarize each potential embodiment or every aspect of the present disclosure.

DETAILED DESCRIPTION

Figure 1A:
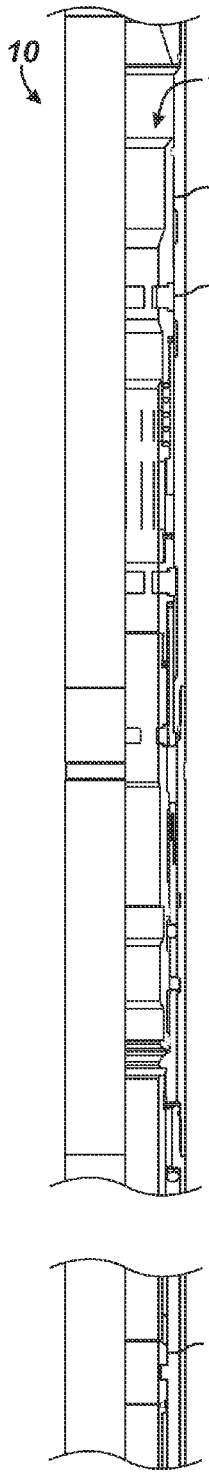
FIG. 1A (Prior Art)
FIGS. 1A-1C show a completion isolation valve having an internal ball valve actuated by a stinger according to the prior art.
Figure 1B:
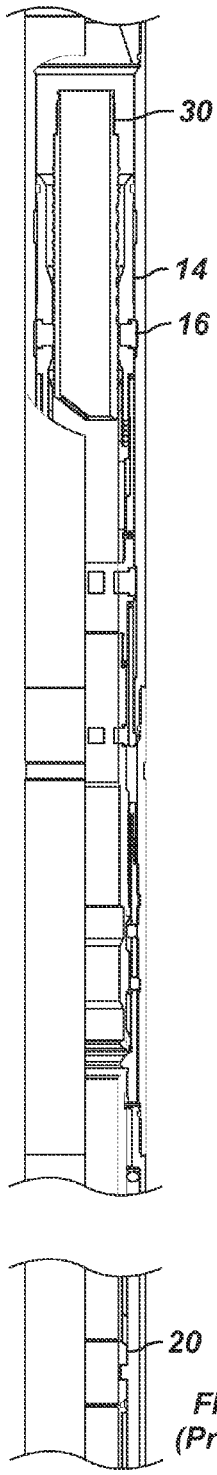
FIG. 1B (Prior Art)
Figure 1C:
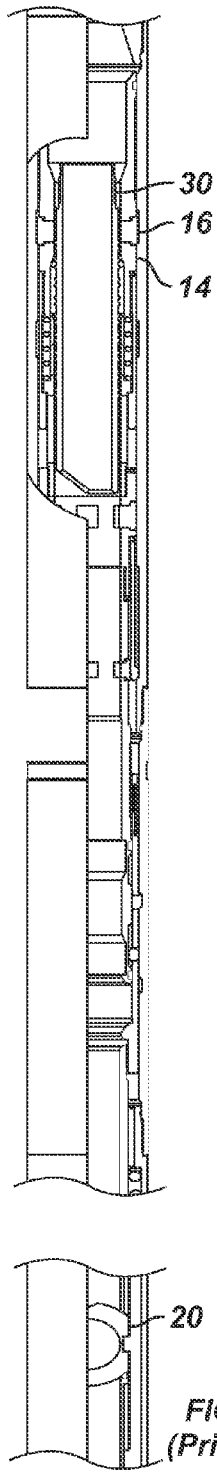
FIG. 1C (Prior Art)
Figure 2:
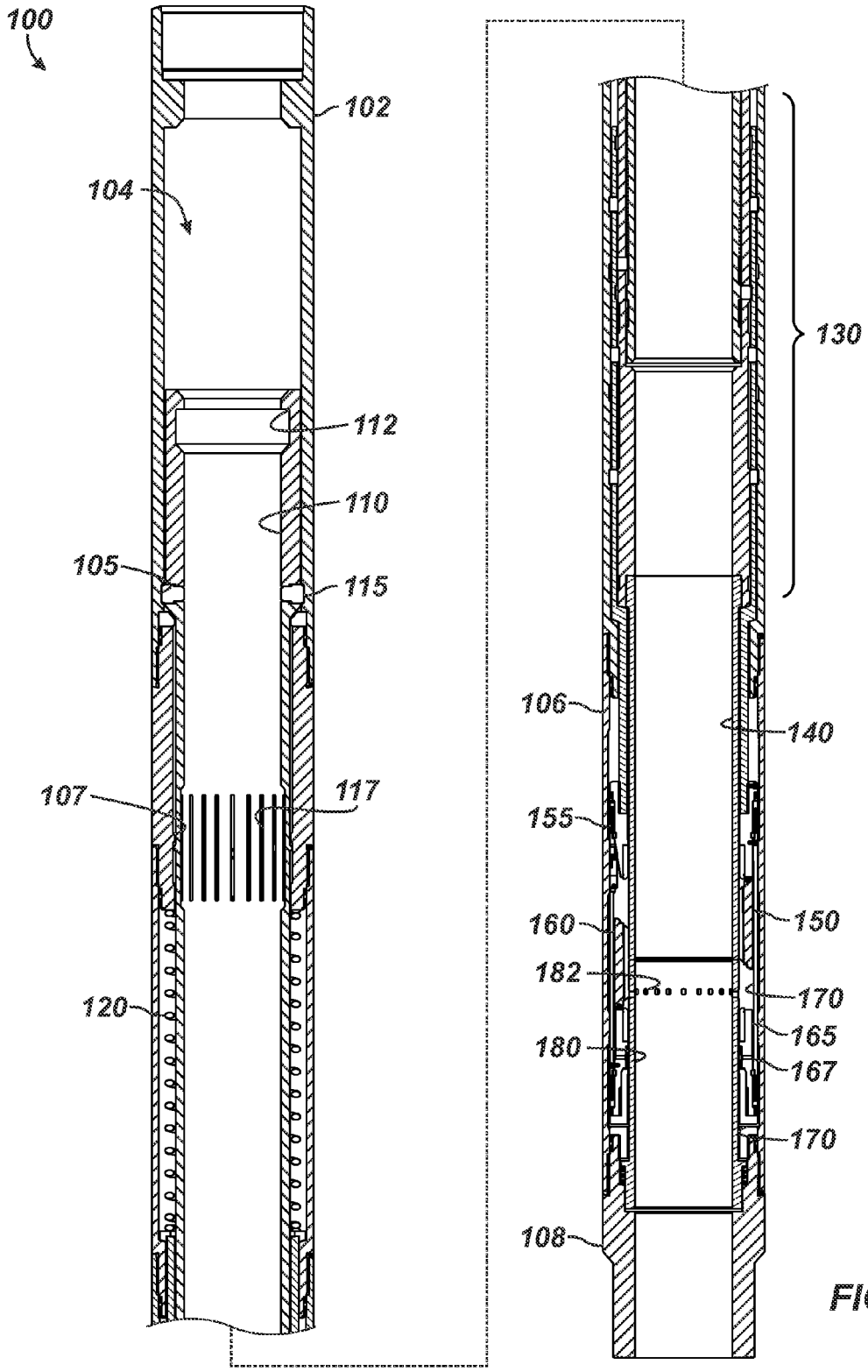
FIG. 2 is a cross-sectional view of a downhole valve according to the present disclosure in a run-in condition with first and second flappers open.

A downhole valve 100 in FIG. 2 forms part of a completion assembly (not shown) with the tool's upper sub 102 connected to an upper completion and the tool's lower sub 108 connected to a lower completion. In use, the valve 100 isolates the upper and lower completions from one another using a closure device, shown here as including a first (upper) flapper 150 and a second (lower) flapper 160. The upper flapper 150 controls pressure from below the valve 100 when closed and opens downwards into the tool's bore 104, while the lower flapper 160 controls pressure from above the valve 100 when closed and opens upwards into the tool's bore 104.

Figure 3:
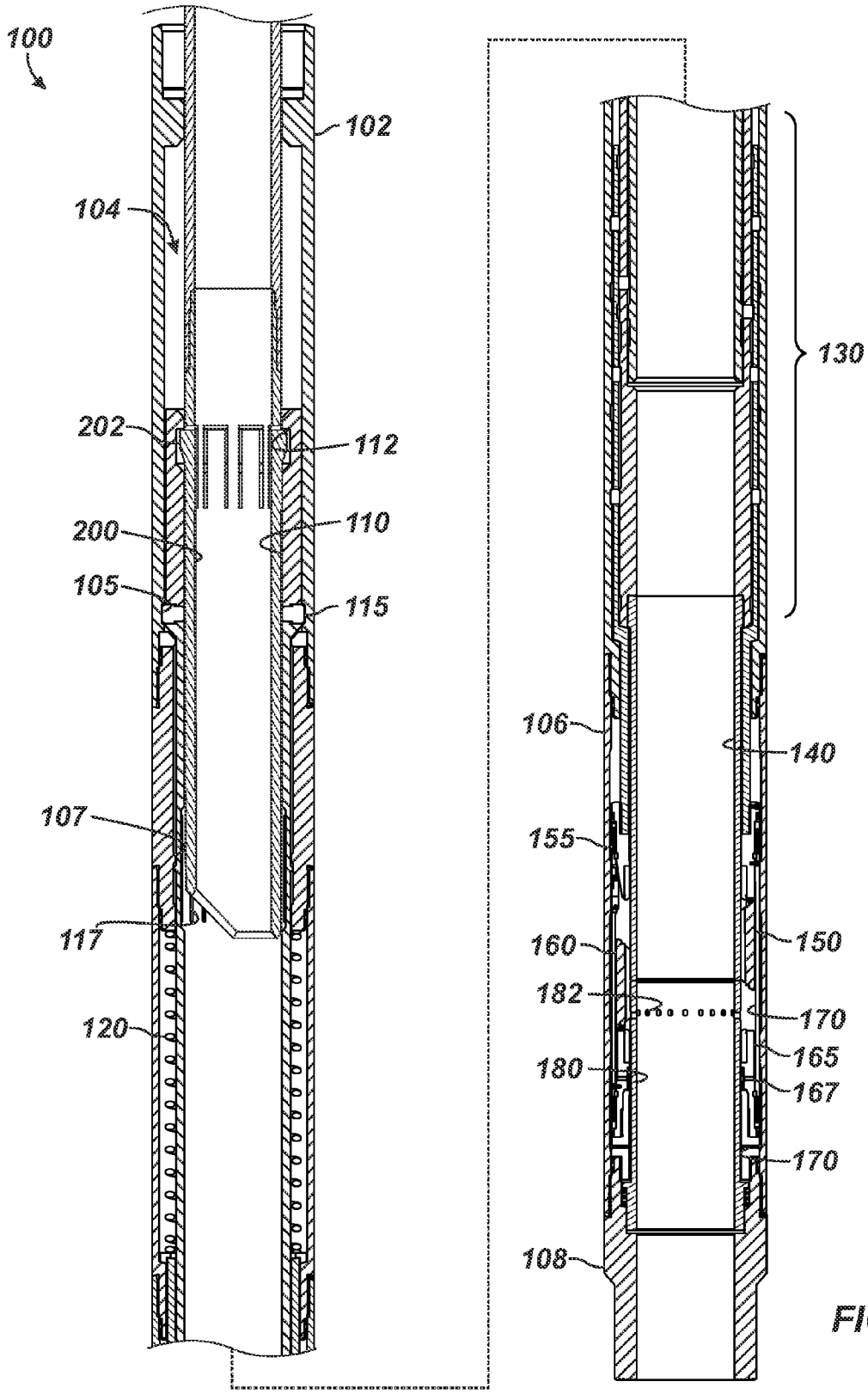
FIG. 3 shows the downhole valve of FIG. 2 in an initial closing stage.
Figure 4:
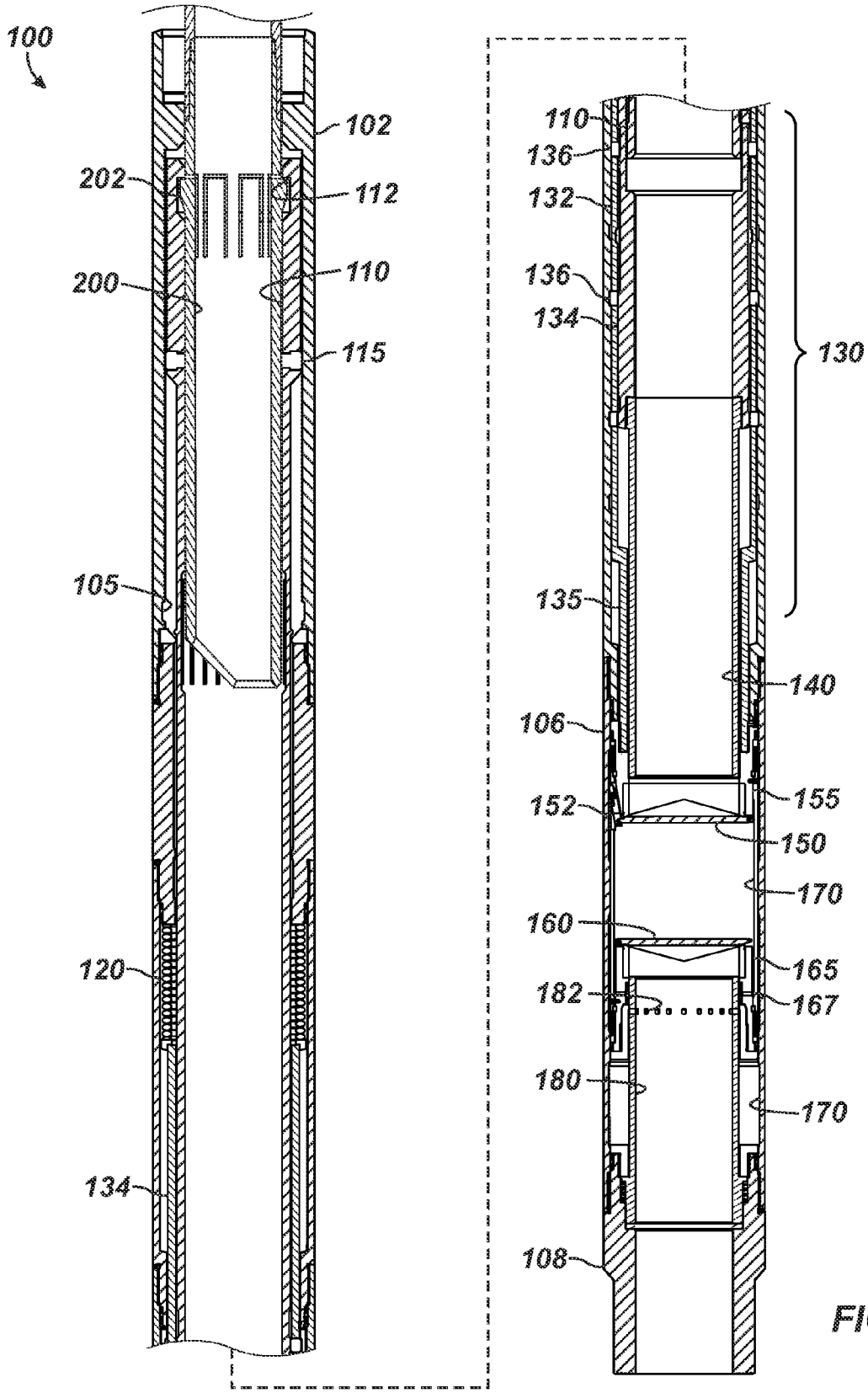
FIG. 4 shows the downhole valve of FIG. 2 in a closed condition.

The flappers 150/160 are shown in open positions in FIGS. 2 and 3 and are shown in closed positions in FIG. 4. The actual opening and closing of the flappers 150/160 uses a predetermined sequence that considers the impact that debris in the well may have on the valves' operation. Upper and lower flow tubes 140/180, an actuating sleeve 110, and a shift and lock mechanism 130 open and close the flappers 150/160 according to the predetermined sequence. A similar procedure for opening and closing the flappers 150/160 is described in detail in incorporated application Ser. No. 11/761,229.

In operation, the upper flapper 150 is closed first to protect the lower flapper 160 from debris that may be dropped in the wellbore from above to the valve 100. To close the upper flapper 150, operators deploy a stinger or shifting tool 200 as shown in FIG. 3 into the valve 100. The stinger 200 has a plurality of fingers 202 that mate with actuating sleeve 110's profile 112 so the sleeve 110 can be pulled toward the upper sub 102. In moving upward, flexible ribs 117 on the actuating sleeve 110 push past a surrounding lower rim 107 defined in the tool's bore 104. As the sleeve 110 then moves further upward, the shift and lock mechanism 130 unlocks the flappers 150/160 and moves the upper flow tube 140 away from the lower flow tube 180. Once the upper flow tube 140 passes the upper flapper 150, the newly freed upper flapper 150 rotates by a spring (not shown) around a pivot point and seals against a valve seat 155 to isolate pressure below the flapper 150 as shown in FIG. 4.

As the shifting tool 200 urges the sleeve 110 further toward the upper sub 102, a latch 152 can be activated to secure the upper flapper 150 in the closed position but may allow the upper flapper 150 to crack open if necessary. After the upper flapper 150 is closed, upward movement of the shifting tool 200 continues to urge the actuating sleeve 110 toward the upper sub 102. The upper flapper 150 and its seat 155 connect by a cage 170 to the lower flapper 160 and its seat 165. With the continued urging of the sleeve 110, the lower flapper 160 and seat 165 also move upward. At the same time, the lower flapper 160 moves away from its flow tube 180, thereby allowing a spring (not shown) to pivot the flapper 160 against its seat 165 to seal pressure from above.

Thereafter, the actuating sleeve 110 being urged closer to the upper sub 102 causes the flappers 150/160 to lock in place by actuating the shift and lock mechanism 130. As shown in FIG. 4, the shift and lock mechanism 130 has a series of intermediate sleeves 132/134, dogs 136, and slots for locking in position as the actuating sleeve 110 shifts the mechanism 130. As shown, the actuating sleeve 110 interacts via dogs and slots with an inner intermediate sleeve 134 that couples to the upper flow tube 140. This inner intermediated sleeve 134 is biased by a spring 120 and interacts via dogs and slots with an outer intermediate sleeve 132 that couples to the upper flapper's seat 155. In this way, shifting and locking of the mechanism 130 using the actuating sleeve 110 moves the flow tube 140 relative to the upper seat 155 and moves the cage 170 relative to the lower flow tube 180 so that the upper and lower flappers 150/160 can be opened and closed.

Figure 5A:
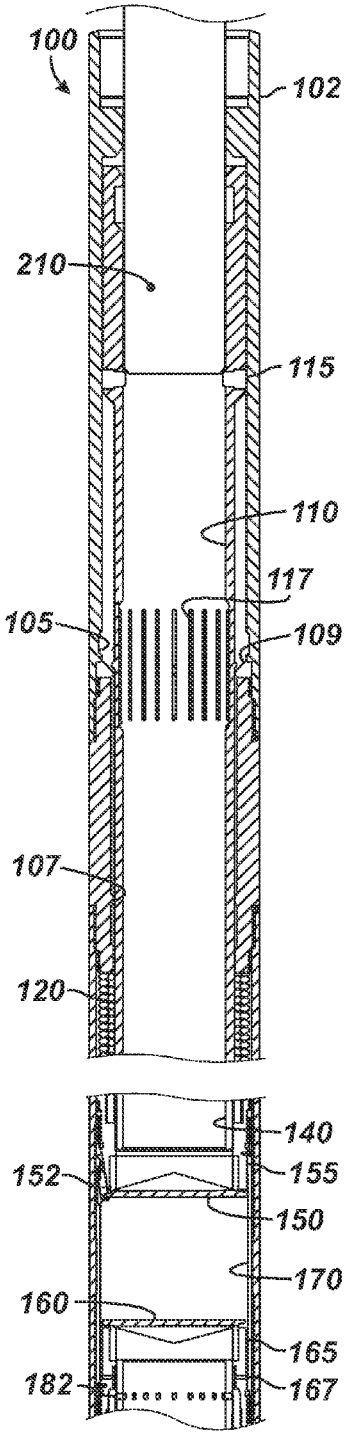
FIGS. 5A-5C show details of the downhole valve of FIG. 2 when a tool is passed therethrough while the valve is in the closed condition.

Once the flappers 150/160 are closed as shown in FIG. 4, it is desirable to protect them from damage by downhole tools being inadvertently or intentionally passed through the valve 100 while in the closed condition. For this reason, the valve 100 has a passable no-go mechanism to protect the flappers 150/160 once closed. As shown in FIG. 5A, an arbitrary downhole tool 210 that is inadvertently or intentionally passed into the valve 100 will engage a series of dogs 115 disposed in the upper sleeve 110 before reaching the closed flappers 150/160. With the valve 100 closed as shown in FIG. 5A, these dogs 115 have moved away from corresponding recesses 105 defined in the surrounding housing 102. Thus, the dogs 115 extend into the valve's bore 104 and can engage the downhole tool 210 passing through the closed valve 100 from above.

When the tool 210 engages the dogs 115, the tool 210 may be initially prevented from passing further into the closed valve 100, thereby preventing inadvertent damage to the closed flappers 150/160. In particular, downward movement of the tool 210 against the extended dogs 115 must push the ribs 117 on the sleeve 110 past an upper rim 109 near the dog's slots 105. This initial catch of the ribs 117 on the rim 109 may indicate to operators that the valve 100 is closed and that passage of the tool 210 could be harmful.

In any event, continued force of the downhole tool 210 against the dogs 115 may eventually move the ribs 117 past rim 109. In this instance, the engaged dogs 115 force the tool 210 to move the sleeve 110, manipulate the shift and lock mechanism (130; FIG. 2), and open the flappers 150/160 before the tool 210 can reach the closed flappers 150/160 and cause damage. This form of opening may occur, for example, when operators inadvertently force the arbitrary downhole tool 210 through the closed valve 100 without realizing the valve 100 is closed. Alternatively, operators may intentionally be opening the valve 100 to reach the lower completion below the valve 100, in which case the tool 210 may actually be a stinger or the like that is purposefully used to open the valve 100.

Regardless of why the tool 210 is passed through the closed valve 100, the lower flapper 150 opens first in the opening sequence. Initially, the downhole tool 210 pushes the upper sleeve 110 downward in the tool 100 by engaging the dogs 115 and forces the ribs 117 on the sleeve 110 past the upper rim 109 as discussed above. As a result, the shift and lock mechanism 130 unlocks the flappers 150/160. Next as shown in FIG. 5A, pressure on both sides of the lower flapper 160 equalizes when ports 167 on the lower seat 165 align with slots 182 formed in the flow tube 180 as the sleeve 110 moves downward. (See also FIG. 4). Thereafter, further movement of the sleeve 110 downward causes the lower flapper 160 to meet its flow tube 180, and further movement downward subsequently causes the lower flapper 160 to open and fit in the annulus between the flow tube 180 and the surrounding housing 106.

After the lower flapper 160 opens, the upper flow tube 140 moves toward the upper flapper 150 as the shift and lock mechanism 130 is manipulated by the downward moving tool 210. Before the flow tube 140 contacts the upper flapper 150, pressure on both sides of the flapper 150 may be equalized. Thereafter, the flow tube 140 meets the upper flapper 150 and pivots it to the open position. Subsequently, the flappers 150/160 are locked in place by further manipulation of the shift and lock mechanism 130.

Figure 5B:
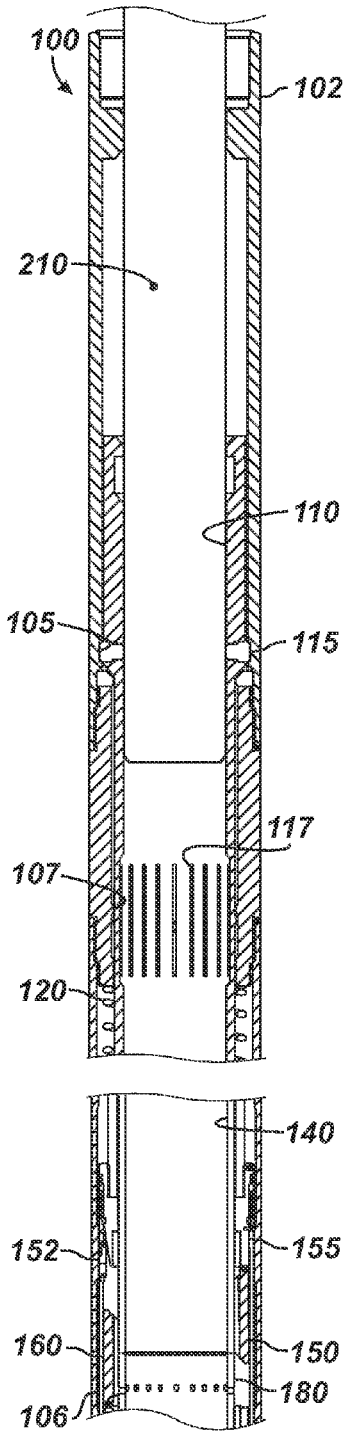

Once opened as shown in FIG. 5B, the downhole tool 210 can pass through the valve 100 while the flappers 150/160 remain open. In this way, the flappers 150/160 can be opened to prevent damage when operators either intentionally or accidentally pass the tool 210 into the valve 100. Advantageously, the valve 100 has an internal bore 104 that is larger than available with a ball valve, because the disclosed valve 100 uses the dual flappers 150/160.

Figure 5C:
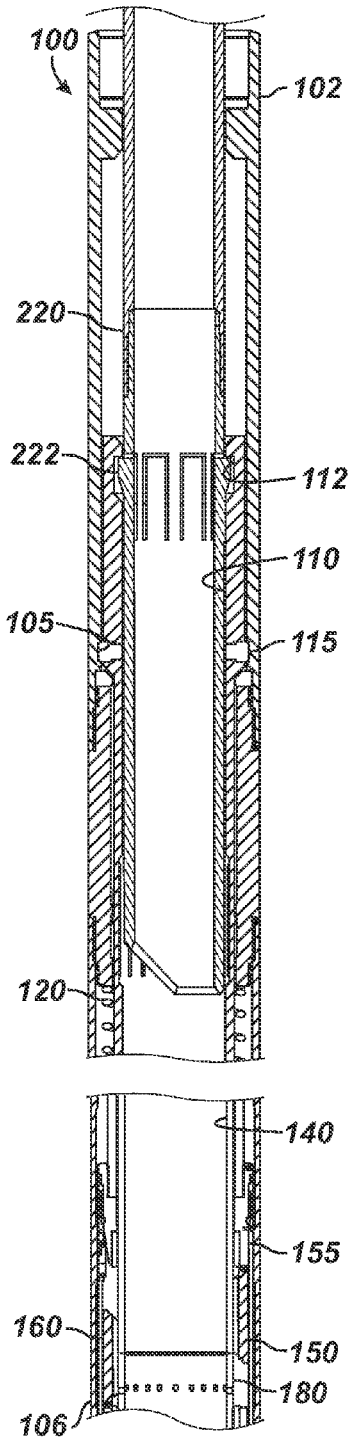

Closing the flappers 150/160 uses the procedure outlined previously. As shown in FIG. 5C, for example, fingers 222 on a stinger or other tool 220 can engage the upper sleeve's profile 112 so that the sleeve 110 can be pulled upward in the valve 100 to initiate the closing procedure for the valve 100 outlined previously for the mechanically operated downhole valve 100. For a hydraulic actuated downhole valve, hydraulic pressure may be used or exhausted, depending on the design, to allow the flappers 150/160 to go closed. Once the flappers 150/160 have closed, the no-go mechanism is once again realized.

Although the actuating sleeve 110, profile 112, dogs 115, slot 105, etc. of the present disclosure have been discussed in connection with the valve 100 having dual flappers 150/160, it will be appreciated with the benefit of the present disclosure that these features can be used for a valve having a single flapper. In addition, the teachings of the present disclosure can be used in a fail-safe type of safety valve (as represented by the disclosed valve 100) and can be used in a hydraulic type of safety valve.

For example, a suitable example of a fail-safe type of safety valve having a single flapper that can use the disclosed features is the SSSV (Subsurface Safety Valve) available from Weatherford—the Assignee of the present disclosure. The SSSV has a single flapper and uses a hydraulic opening piston and a spring closure mechanism. As another example, a suitable example of a hydraulic type of safety valve having a single flapper that can use the disclosed features is the DDV™ (Downhole Deployment Valve) available from Weatherford—the Assignee of the present disclosure. The DDV has a single flapper and uses a hydraulic opening piston and a hydraulic closing piston. In either case, the protected opening of the flapper can use the same components and procedures outlined above with reference to the dual flapper valve, although without the added complexity of having to open the second flapper.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole valve, comprising:

a housing having a bore;

a closure device actuatable between opened and closed conditions in the bore and having at least one flapper, the closure device in the closed condition disposed across the bore to isolate the bore in first and second directions; and an actuating sleeve axially movable in the bore between first and second positions and actuating the closure device, the actuating sleeve having:

an internal profile engageable in the first direction and moving the actuating sleeve to the first position to actuate the closure device to the closed condition, and at least one moveable dog movable axially in the bore with the actuating sleeve and movable between extended and retracted conditions relative to the bore, the at least one movable dog having the extended condition extended into the bore when the actuating sleeve has the first position, the at least one movable dog having the retracted condition retracted from the bore when the actuating sleeve has the second position, wherein the at least one movable dog in the extended condition engages a tool passing in the second direction in the bore and moves the actuating sleeve to the second position to actuate the closure device to the opened condition, and wherein the at least one movable dog, upon the actuating sleeve reaching the second position, moves to the retracted condition retracted from the bore and releases passage of the tool in the second direction through the closure device in the open condition.

2. The valve of claim 1, wherein the closure device comprises a first flapper actuatable between opened and closed positions in the bore by movement of the actuating sleeve, the first flapper in the closed position disposed across the bore to isolate the bore in the first direction.

3. The valve of claim 2, wherein the closure device comprises a second flapper actuatable between opened and closed positions in the bore by movement of the actuating sleeve, the second flapper in the closed position disposed across the bore to isolate the bore in the second direction opposite to the first direction.

4. The valve of claim 3, wherein the closure device comprises:

a first flow tube axially movable in the bore between first and second positions by interaction with the actuating sleeve, the first flow tube in the third position actuating the first flapper to the closed position and in the fourth position actuating the first flapper to the opened position; and a second flow tube disposed in the bore and actuating the second flapper to the closed position when the second flapper is in a fifth position in the housing and actuating the second flapper to the opened position when the second flapper is in a second position in the housing.

5. The valve of claim 1, wherein the actuating sleeve comprises a plurality of flexible ribs disposed thereon, the flexible ribs engageable in the first direction with a first rim inside the housing when the actuating sleeve is in the second position, the flexible ribs engageable in the second direction with a second rim inside the housing when the actuating sleeve is in the first position.

6. The valve of claim 1, comprising a lock mechanism having a plurality of intermediate sleeves, dogs, and slots disposed between the actuating sleeve and the closure device, the lock mechanism shiftable by movement of the actuating sleeve and locking in first and second positions in the housing.

7. A downhole valve, comprising:

a housing having a bore;

a closure device actuatable between opened and closed conditions in the bore; and an actuating sleeve axially movable in the bore between first and second positions in the housing, the actuating sleeve having:

an internal profile engageable in a first direction to move the actuating sleeve to the first position, and at least one moveable dog movable axially in the bore with the actuating sleeve and movable between extended and retracted conditions relative to the bore, the at least one movable dog having the extended condition extended into the bore when the actuating sleeve has the first position, the at least one movable dog having the retracted condition retracted from the bore when the actuating sleeve has the second position, wherein the at least one movable dog in the extended condition engages a tool passing in a second direction in the bore and moves the actuating sleeve to the second position to actuate the closure device to the opened condition, wherein the at least one movable dog, upon the actuating sleeve reaching the second position, moves to the retracted condition retracted from the bore and releases passage of the tool in the second direction through the closure device in the open condition;

wherein the closure device comprises:

a first flapper axially movable in the bore and pivotable between opened and closed positions, the first flapper in the closed position disposed across the bore to isolate the bore in the first direction;

a first flow tube axially movable in the bore between third and fourth positions by interaction with the actuating sleeve, the first flow tube in the third position actuating the first flapper to the closed position and in the fourth position actuating the first flapper to the opened position;

a second flapper axially movable in the bore and pivotable between opened and closed positions, the second flapper in the closed position disposed across the bore to isolate the bore in the second direction opposite to the first direction; and a second flow tube disposed in the bore and actuating the second flapper, the second flow tube actuating the second flapper to the closed position when the second flapper is in a fifth position in the bore and actuating the second flapper to the opened position when the second flapper is in a sixth position in the bore.

8. The valve of claim 7, comprising:

a first seat axially movable in the bore and having the first flapper pivotably connected thereto, a second seat axially movable in the bore and having the second flapper pivotably connected thereto, and a cage connecting the first and second seats together and axially movable in the bore.

9. The valve of claim 8, wherein the actuating sleeve movably interacts with a first intermediate sleeve, and wherein the first flow tube movably interacts with the first intermediate sleeve.

10. The valve of claim 9, wherein the first intermediate sleeve is biased in the second direction in the housing.

11. The valve of claim 9, wherein the first intermediate sleeve movably interacts with a second intermediate sleeve, and wherein the first seat, the second seat, and the cage movably interact with the second intermediate sleeve.

12. The valve of claim 7, wherein the actuating sleeve comprises a plurality of flexible ribs disposed thereon, the flexible ribs engageable with a first rim inside the housing when the sleeve is in the second position and engageable with a second rim inside the housing when the sleeve is in the first position.

13. The valve of claim 7, comprising a lock mechanism having a plurality of intermediate sleeves, dogs, and slots disposed between the actuating sleeve and the first flow tube, the lock mechanism shiftable by movement of the actuating sleeve and locking in first and second positions in the housing.

14. A downhole valve protection method, comprising:

deploying a valve downhole, the valve having a bore with a closure disposed therein, the closure operable between opened and closed conditions;

engaging a tool against at least one dog extendable from a sleeve into the bore of the valve as the tool moves downhole into the valve while in the closed condition;

shifting the sleeve with the tool engaged against the at least one dog while moving downhole in the valve;

automatically actuating the closure with the sleeve from the closed condition to the opened condition before the tool moves downhole to the closure by maintaining the at least one dog in the extended condition engaging the tool as the sleeve moves toward a second position; and allowing passage of the tool downhole in the valve past the closure in the opened condition by retracting the at least one dog from the bore of the valve when the sleeve has the second position.

15. The method of claim 14, wherein the closure comprises first and second flappers disposed in the bore, the first and second flappers being rotatable in opposing directions between opened and closed positions in the bore, and wherein automatically actuating the closure comprises:

moving the first flapper to the opened position before the tool moves downhole to the first flapper by rotating the first flapper with the shifting sleeve; and moving the second flapper to the opened position before the tool moves downhole to the second flapper by rotating the second flapper with the shifting sleeve.

16. The method of claim 15, wherein the first flapper moves to the opened position before the second flapper.

17. The method of claim 14, wherein the tool comprises an arbitrary tool, and wherein engaging the tool comprises unintentionally deploying the arbitrary tool into the valve.

18. The method of claim 14, wherein the tool comprises a stinger, and wherein engaging the tool comprises intentionally deploying the stinger into the valve.

19. The method of claim 18, further comprising engaging a shoulder on the stinger against a profile on the sleeve as the stinger moves uphole into the valve while in the opened condition.

20. The method of claim 19, further comprising:

shifting the sleeve with the stinger engaged against the profile while moving uphole in the valve; and actuating the closure from the opened condition to the closed condition with the shifting sleeve engaged by the stinger.

21. The method of claim 19, wherein the closure comprises first and second flappers disposed in the bore, the first and second flappers being rotatable in opposing directions between opened and closed positions in the bore, and wherein automatically actuating the closure comprises:

moving the second flapper to the opened position by rotating the second flapper with the shifting sleeve; and moving the first flapper to the opened position by rotating the first flapper with the shifting sleeve.

22. The method of claim 21, wherein the second flapper moves to the closed position before the first flapper.

* * * * *